United States Patent [19]

Uphoff et al.

[11] Patent Number: 4,575,012

[45] Date of Patent: Mar. 11, 1986

[54] BEARING CONSTRUCTION FOR SNOW CONE MACHINE

[75] Inventors: Irvin A. Uphoff; Leon F. Williams, both of Dallas, Tex.

[73] Assignee: Leon F. Williams, Dallas, Tex.

[21] Appl. No.: 601,706

[22] Filed: Apr. 18, 1984

[51] Int. Cl.[4] ..... B02C 19/12

[52] U.S. Cl. ..... 241/92; 241/101.2; 241/DIG. 17

[58] Field of Search ..... 308/190, 191, 187, 187.1, 308/245; 241/101.2, 92, DIG. 17

[56] References Cited

U.S. PATENT DOCUMENTS

| | | | |
|---|---|---|---|
| 555,002 | 2/1896 | Hanahan | 241/DIG. 17 X |
| 1,935,104 | 11/1933 | Weigel | 241/DIG. 17 X |
| 4,394,984 | 7/1983 | Hight et al. | 241/DIG. 17 X |

*Primary Examiner*—Mark Rosenbaum
*Attorney, Agent, or Firm*—Michael A. O'Neil

[57] ABSTRACT

An ice shaving apparatus (10) includes a housing (12) having a surface (20) for supporting an ice billet. A cutting head (59) is rotatably supported in one end of the housing and functions to discharge ice shaved from the billet through an aperture (50). The cutting head is rotatably supported in a drum (70) having a boss (90, 120) projecting rearwardly therefrom. The boss has a bearing receiving aperture (92, 122) formed therethrough. Sealed ball bearings (100, 130) are positioned in the aperture and rotatably support a shaft (48, 48') which in turn supports the cutting head. A slinger (110, 160) is mounted on the shaft between the cutting head and the bearings and serves to prevent water from engaging the bearings.

9 Claims, 4 Drawing Figures

BEARING CONSTRUCTION FOR SNOW CONE MACHINE

TECHNICAL FIELD

This invention relates to an improved bearing construction which is particularly adapted for use in conjunction with snow cone machines and similar applications.

BACKGROUND AND SUMMARY OF THE INVENTION

One currently popular form of confection is known as the snow cone. Snow cones are made from shaved ice which is preferably deposited directly from the ice shaving apparatus into a suitable container, for example a paper cup. Flavored syrup is then deposited onto the shaved ice in the container to complete the snow cone. Typically, the snow cone is consumed in the solid state, that is, prior to any significant melting of the ice.

As will be apparent from the foregoing, a successful snow cone operation requires a reliable source of shaved ice. One type of ice shaving apparatus which has been used in the past to provide shaved ice for snow cones includes a chamber for receiving an ice billet and having a rachet mechanism for advancing the ice billet toward a cutting head. The cutting head includes a plurality of blades for shaving ice from the billet and slots for directing the shaved ice into the interior of the cutting head. Vanes are provided within the cutting head for directing the shaved ice outwardly and into the snow cone container.

Heretofore the rotational support for the cutting head of such an ice shaving apparatus has comprised a bearing system including a brass sleeve bearing and a thrust bearing. Perhaps due to the reduced temperatures that are encountered in the operation of an ice shaving apparatus, such bearing systems have not performed satisfactorily. It will be understood that any downtime due to bearing failure can be very costly due to the fact that without a source of shaved ice the opportunity to sell snow cones is lost entirely.

The present invention comprises an improved bearing structure which is particularly adapted for use in ice shaving apparatus of the type used in snow cone machines. The use of the invention is highly advantageous in that by means thereof the bearing failures that have characterized prior bearing systems used in ice shaving apparatus are entirely eliminated. This results in substantially increased revenue due to the elimination of lost sales opportunities.

In accordance with the broader aspects of the invention, the cutting head of an ice shaving apparatus is rotatably supported by means of antifriction bearings. The antifriction bearings are of the sealed variety, thereby eliminating bearing failure resulting from the entry of water into the bearings. In addition, a slinger is provided for preventing water resulting from operation of the apparatus from contacting the bearings which rotatably support the cutting head.

DESCRIPTION OF THE DRAWINGS

A more complete understanding of the invention may be had by reference to the following Detailed Description when taken in conjunction with the accompanying Drawings wherein.

DETAILED DESCRIPTION

Figure 1:
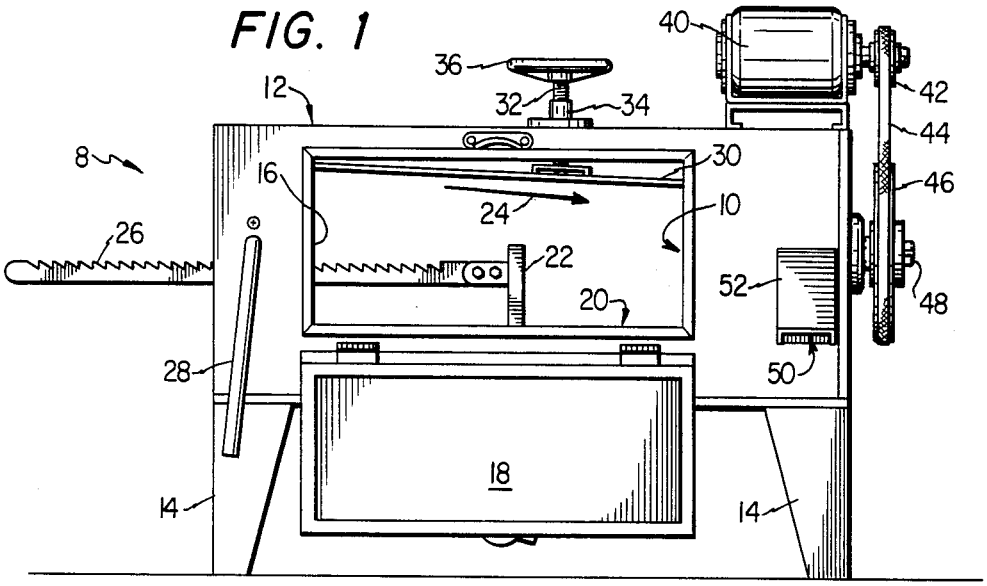
FIG. 1 is a front view of a snow cone machine including an ice shaving apparatus incorporating the invention.

Referring now to the Drawings, and particularly to FIG. 1 therein, there is shown a snow cone machine 8 including an ice shaving apparatus 10 incorporating the present invention. A housing 12 is supported on a plurality of legs 14. The housing 12 comprises a substantially enclosed chamber and includes an access port 16 which is normally closed by a door 18. The access portion 16 extends to an ice billet receiving and supporting surface 20.

A plate 22 is mounted within the housing 12 and is adapted to move an ice billet supported on the surface 20 in the direction of the arrow 24. A ratchet 26 is connected to the plate 22. A pawl (not shown) is secured to a handle 28 and is adapted upon actuation of the handle 28 to advance the ratchet 26 and therefore the plate 22. In this manner the ice billet is moved in the direction of the arrow 24.

The vertical dimension of the chamber comprising the housing 12 is determined by a plate 30. A threaded shaft 32 is rotatably secured to the plate 30 and is threadedly engaged with a boss 34 secured to the housing 12. Thus, upon rotation of a hand wheel 36 secured to one end of the threaded shaft 32, the positioning of the plate 30 is adjusted in accordance with dimensions of the ice billet being shaved at any particular time.

A motor 40 is supported on the housing 12 and drives a pulley 42. A belt 44 is constrained around the pulley 42 and pulley 46 secured to a shaft 48. Upon actuation of the motor 40, the shaft 48 is rotated by means of the pulley 42, the belt 44 and the pulley 46. The shaft 48 drives a cutting head (not shown in FIG. 1) which functions to shave ice from the ice billet supported on the surface 20 to discharge the shaved ice through a discharge aperture 50 of a discharge chute 52.

Figure 2:
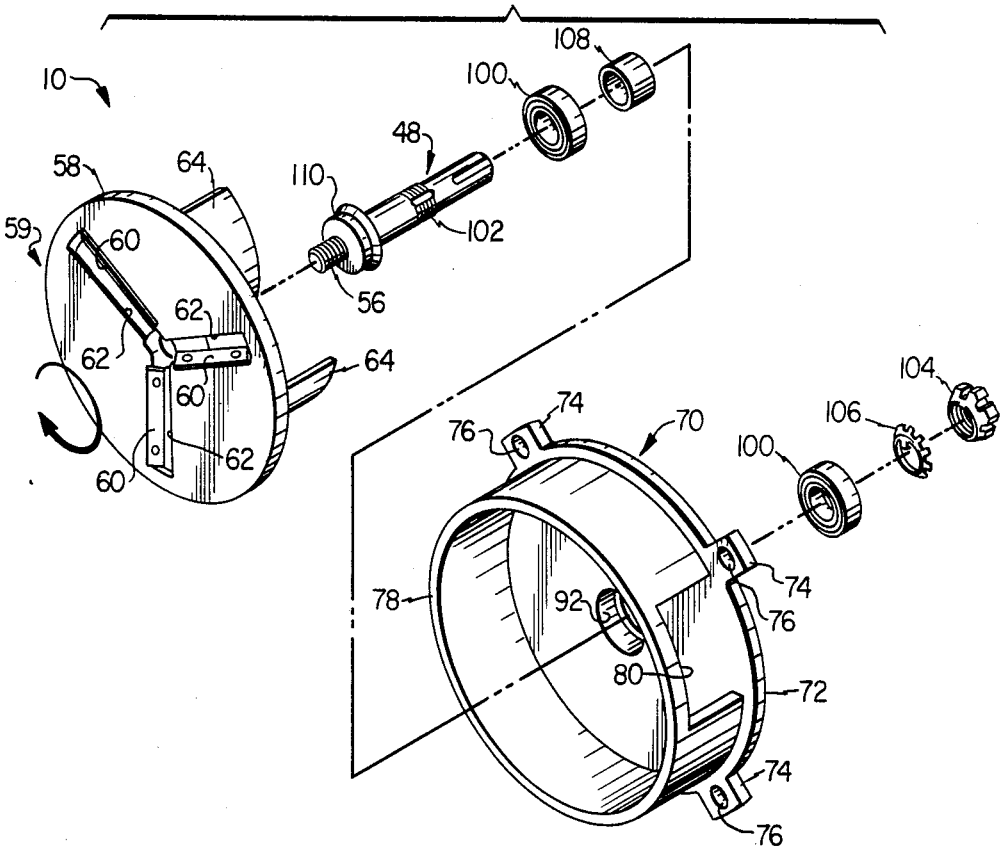
FIG. 2 is an exploded perspective view showing the cutting head and the drum of the apparatus of FIG. 1.

Referring now to FIG. 2, the shaft 48 has a threaded projection 56 extending to one end thereof. The projection 56 is normally threadedly engaged with a threaded aperture formed in a circular plate 58 comprising a cutting head 59 of the ice shaving apparatus 10. A plurality of blades 60 are supported on the circular plate 58 and function to shave ice from an ice billet supported on the surface 20. An aperture 62 extends from each blade 60 so that ice shaved from the ice billet by operation of the blades 60 is received through the apertures 62. A plurality of vanes 64 are supported on the plate 58 for rotation therewith and function to propel shaved ice received through the aperture 62 outwardly.

The cutting head 59 comprising the plate 58, the blades 60 and the vanes 64 is rotatably supported in a drum 70. The drum 70 includes a circular rear plate 72 having a plurality of ears 74 extending therefrom. Each ear 74 is provided with an aperture 76, whereby the drum 70 is supported in the housing 12. An annular flange 78 extends forwardly from the plate 72 and is characterized by the inside diameter which is substantially matched to the outside diameter of the plate 58 of the cutting head 59. The flange 78 has an aperture 80 formed therein which extends to the discharge chute 52 of the housing 12. Thus, upon rotation of the plate 58, ice shaved from the ice billet by the blades 60 passes through the apertures 62 and is then discharged through aperture 80, the chute 52 and the aperture 50.

Figure 3:
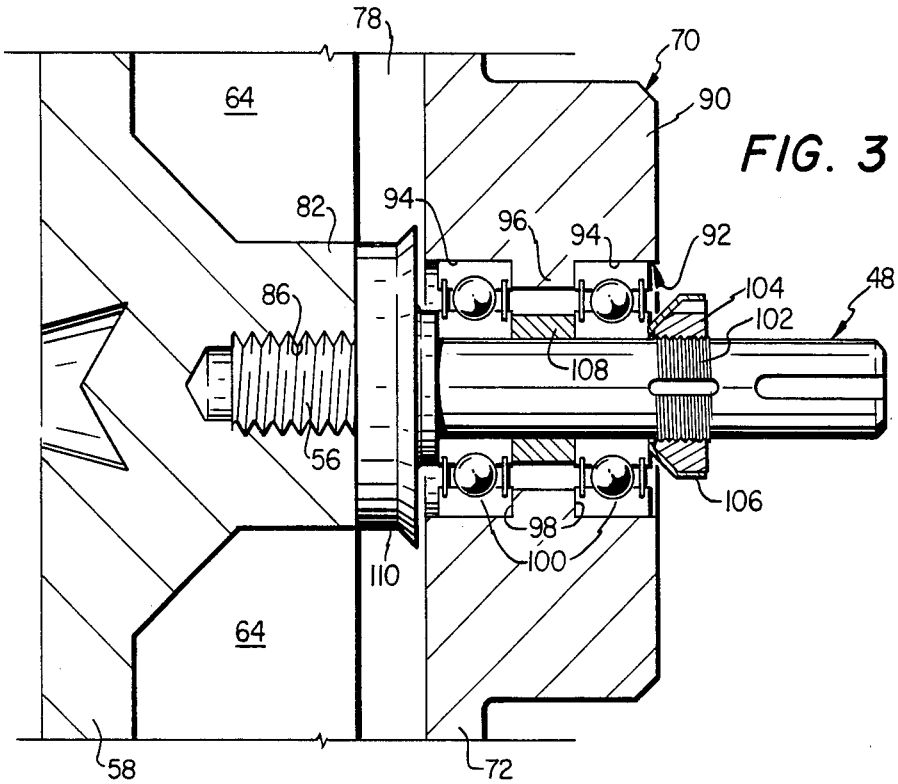
FIG. 3 is an enlarged sectional view illustrating a first embodiment of the invention.

Referring now to FIG. 3, a first embodiment of the invention is shown. The plate 58 of the cutting head 59 has a boss 82 extending rearwardly therefrom. A threaded aperture 86 is formed in the boss 82 and threadedly receives the projection 56 of the shaft 48 to secure the plate 58 to the shaft 48. A boss 90 projects rearwardly from the rear plate 72 of the drum 70 and has a bearing receiving aperture 92 formed therein. The aperture 92 is characterized relatively large diameter portions 94 positioned at the opposite ends thereof and separated by a spacer portion 96 defining opposed bearing locating surfaces 98.

A pair of sealed ball bearings 100 are received in the aperture 92 of the boss 90. More particularly, the ball bearings 100 are supported in the relatively large diameter portions 94 of the aperture 92 and are at least partially located with respect to one another by the surfaces 98 of the spacer portion 96. The ball bearings 100 rotatably support the shaft 48 and therefore the cutting head 59 for rotation relative to the drum 70.

The shaft 48 includes a threaded portion 102. A nut 104 is threadedly engaged with the threaded portion 102 of the shaft 48 and serves to retain the bearings 100 with respect thereto. A lock washer 106 is employed to prevent accidental disengagement of the nut 104. The positioning of the bearings 100 is further assured by means of a spacer 108 which is supported on the shaft 48 and engages the inner races of the bearings 100.

A slinger 110 is supported on the shaft 48 for rotation therewith. The slinger 110 is positioned between the cutting head 59 and the bearings 100 mounted in the aperture 92 of the boss 90. The slinger 110 comprises a relatively large diameter member. The function of the slinger 110 is to centrifugally discharge any water that might occur during operation of the ice shaving apparatus 10, thereby preventing the water from engaging the bearings 100.

Figure 4:
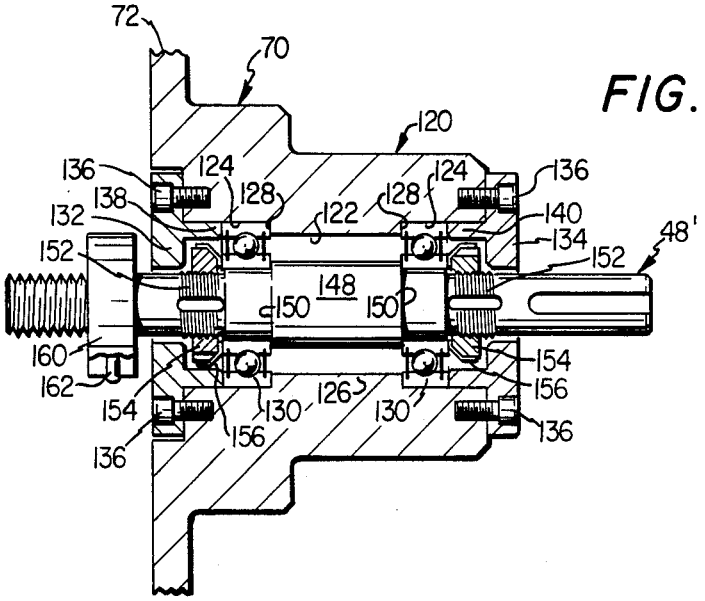
FIG. 4 is an illustration of a second embodiment of the invention.

A second embodiment of the invention is illustrated in FIG. 4. In accordance with the second embodiment, a boss 120 extends rearwardly from the rear plate 72 comprising the drum 70. The boss 120 has a bearing receiving aperture 122 extending therethrough. The aperture 122 is characterized by relatively large diameter bearing receiving portions 124 and a relatively small diameter portion 126 extending to spaced apart shoulders 128.

A pair of sealed ball bearings 130 are supported in the relatively large diameter portions 124 of the aperture 122 extending through the boss 120. The outer races of the bearings 130 engage the shoulders 128 to locate the bearings. A pair of end caps 132 and 134 are secured in the boss 120 by screws 136. The end cap 132 includes an inwardly projecting annular rim 138 which presses the outer race of one of the bearings 130 against the corresponding shoulder 128. The end cap 134 includes a similar annular rim 140 which presses the outer race of the opposite bearing 130 against the corresponding shoulder 128.

A shaft 48' is identical in function, but somewhat different in construction when compared with the shaft 48. The shaft 48' includes a spacer portion 148 having opposed shoulders 150 which engage the inner races of the bearings 130. The shaft 48' includes a pair of threaded portions 152 each having a nut 154 threadedly engaged therewith. The nuts 154 function to press the inner races of the bearings 130 into engagement with the shoulders 150 of the spacer portion 148 of the shaft 48'. Lock washers 156 are utilized to secure the nuts 154 in place.

A slinger 160 is mounted on the shaft 48' and is positioned between the cutting head 59 and the bearings 130. The slinger 160 is secured in place by a pin 162 received in an aperture extending through the slinger 160 and into the shaft 48'. The slinger 160 comprises a relatively large diameter which functions to centrifugally discharge any water occuring during operation of the ice shaving apparatus 10, thereby preventing the water from engaging the bearings 130.

From the foregoing, it will be understood that the present invention comprises substantial improvements relating to construction of ice shaving apparatus. In particular, the problems that have heretofore characterized ice shaving apparatus due to bearing failure are completely eliminated by means of the present invention. Thus, the present invention utilizes sealed, antifriction bearings to provide rotatable support for the cutting head of an ice shaving apparatus which is characterized by long term, substantially maintenance free operation.

Although preferred embodiments of the invention have been illustrated in the accompanying Drawings and described in the foregoing Detailed Description, it will be understood that the invention is not limited to the embodiments of the invention disclosed, but is capable of numerous rearrangements and modifications and substitutions of parts and elements without departing from the spirit of the invention.

We claim:

1. An ice shaving apparatus comprising:

a stationary drum comprising a generally planar rear plate wall and an annular rim having a predetermined inside diameter and having a discharge aperture formed therein;

a cutting head comprising a circular plate having an outside diameter substantially equal to the inside diameter of the rim of the drum and adapted for rotation therein;

the circular plate of the cutting plate having a plurality of radially extending slots formed therethrough;

a plurality of blades each mounted on the circular plate for shaving ice from a billet so that the shaved ice passes through one of the slots in the plate and into the drum;

a plurality of vanes secured to the circular plate of the cutting head for rotation therewith for directing shaved ice received through the slots through the discharge aperture in the drum;

the rear plate of the drum including a boss having an aperture extending therethrough which is coaxial with the rim of the drum and with the circular plate of the cutting head;

the cutting head further including a shaft extending rearwardly from the circular plate through the aperture of the boss of the rear plate of the drum;

a plurality of spaced apart, sealed, antifriction bearing means mounted in the aperture of the boss of the drum and receiving the shaft of the cutting head therethrough and thereby rotatably supporting the cutting head; and slinger means comprising a relatively large diameter portion mounted on the shaft for rotation therewith and positioned within the drum between the cutting head and the antifriction bearing means for centrifugally discharging water from the shaft and thereby preventing water resulting from operation of the cutting head from engaging the antifriction bearing means.

2. The ice shaving apparatus according to claim 1 wherein the antifriction bearing means comprises spaced apart, sealed ball bearings for rotatably supporting the shaft and the cutting head, said ball bearings being mounted in the aperture formed through the boss of the rear plate of the drum.

3. The ice shaving apparatus according to claim 2 wherein the aperture in the boss is further characterized by spaced apart shoulders for positioning the ball bearings therein.

4. The ice shaving apparatus according to claim 3 wherein the shaft includes at least one threaded portion, and further including at least one nut threadedly engaged with the threaded portion of the shaft for fixing the positioning of at least one of the ball bearings with respect thereto.

5. An ice shaving apparatus comprising:

means defining a surface for supporting an ice billet;

means for advancing the ice billet toward one end of the supporting surface;

a cutting head positioned at said one end of the ice billet supporting surface and comprising a circular plate, a plurality of blades mounted on the circular plate for shaving ice from the ice billet, a plurality of apertures each positioned adjacent one of the blades for receiving shaved ice therethrough, and a plurality of vanes for projecting the shaved ice outwardly;

a drum positioned at said one end of the ice billet supporting surface and surrounding the cutting head, said drum comprising a circular rear plate and an annular wall extending forwardly from the rear plate and surrounding the cutting head, said annular wall having a discharge aperture formed therein for receiving shaved ice from the vanes of the cutting head;

the circular rear plate of the drum including a rearwardly projecting boss having a bearing supporting aperture formed therein;

said cutting head further including a shaft secured to the circular plate and extending through the aperture of the boss of the drum;

spaced apart, sealed, antifriction bearing means mounted in the aperture of the boss of the drum and having the shaft extending therethrough for rotatably supporting the shaft and the cutting head;

a slinger comprising a relatively large diameter portion mounted in the shaft for rotation therewith and positioned within the drum between the cutting head and the antifriction bearing means for centrifugally discharging water from the shaft and thereby preventing the water resulting from operation of the cutting head from engaging the antifriction bearing means; and drive means for rotating the shaft and the cutting head mounted thereon relative to the drum and thereby shaving ice from the ice billet supported on the ice billet supporting surface.

6. The ice shaving apparatus according to claim 5 wherein the aperture formed through the boss is further characterized by opposed surfaces for positioning the spaced apart, sealed, antifriction bearing means.

7. The ice shaving apparatus according to claim 6 wherein the spaced apart, sealed, antifriction bearing means comprise ball bearings.

8. The ice shaving apparatus according to claim 5 further characterized by spacer means for maintaining separation between the spaced apart, sealed, antifriction bearing means.

9. The ice shaving apparatus according to claim 5 wherein the shaft includes at least one threaded portion and further including at least one nut threadedly engaged with the threaded portion of the shaft for positioning at least one of the sealed, antifriction bearing means with respect thereto.

* * * * *